US010697271B2

(12) United States Patent
Eidem et al.

(10) Patent No.: US 10,697,271 B2
(45) Date of Patent: Jun. 30, 2020

(54) METHOD FOR ACHIEVING ZONAL CONTROL IN A WELLBORE WHEN USING CASING OR LINER DRILLING

(71) Applicant: STATOIL PETROLEUM AS, Stavanger (NO)

(72) Inventors: Morten Eidem, Trondheim (NO); Gjermund Grimsbo, Trondheim (NO); Torgeir Wenn, Stavanger (NO)

(73) Assignee: STATOIL PETROLEUM AS, Stavanger (NO)

( * ) Notice: Subject to any disclaimer, the term of this patent is extended or adjusted under 35 U.S.C. 154(b) by 301 days.

(21) Appl. No.: 15/576,048

(22) PCT Filed: Apr. 20, 2016

(86) PCT No.: PCT/NO2016/050073
§ 371 (c)(1),
(2) Date: Nov. 21, 2017

(87) PCT Pub. No.: WO2016/186509
PCT Pub. Date: Nov. 24, 2016

(65) Prior Publication Data

US 2018/0156011 A1 Jun. 7, 2018

(30) Foreign Application Priority Data

May 21, 2015 (GB) ..... 1508730.7

(51) Int. Cl.
*E21B 34/14* (2006.01)
*E21B 7/20* (2006.01)
(Continued)

(52) U.S. Cl.
CPC ..... *E21B 34/14* (2013.01); *E21B 7/20* (2013.01); *E21B 34/12* (2013.01); *E21B 43/086* (2013.01);
(Continued)

(58) Field of Classification Search
CPC ..... E21B 7/20; E21B 34/14; E21B 2034/007
See application file for complete search history.

(56) References Cited

U.S. PATENT DOCUMENTS 3,236,307 A * 2/1966 Brown ..... E21B 31/107 166/301
3,545,553 A * 12/1970 Johnson ..... E21B 10/66 175/258
(Continued)

FOREIGN PATENT DOCUMENTS

WO WO 03/023185 A1 3/2003
WO WO 2007/038852 A1 4/2007
(Continued)

OTHER PUBLICATIONS

International Search Report, issued in PCT/NO2016/050073, dated Aug. 12, 2016.
(Continued)

*Primary Examiner* — Shane Bomar
(74) *Attorney, Agent, or Firm* — Birch, Stewart, Kolasch & Birch, LLP

(57) ABSTRACT

A method for achieving zonal control in a wellbore when using casing or liner drilling includes providing a slotted tubular section in a wellbore while drilling; providing a sleeve adjacent to and radially overlapping with the slotted tubular section, while drilling; and moving the sleeve relative to the slotted tubular section so as to permit and/or restrict flow through the slotted tubular section in one or more selected zones.

25 Claims, 2 Drawing Sheets

(51) Int. Cl.

| | |
|---|---|
| ***E21B 43/08*** | (2006.01) |
| ***E21B 43/10*** | (2006.01) |
| ***E21B 34/12*** | (2006.01) |
| *E21B 34/00* | (2006.01) |

(52) U.S. Cl.
CPC ..... *E21B 43/10* (2013.01); *E21B 2034/007* (2013.01)

(56) References Cited

U.S. PATENT DOCUMENTS

| | | | | |
|---|---|---|---|---|
| 4,484,625 | A * | 11/1984 | Barbee, Jr. | E21B 37/08 166/185 |
| 4,880,059 | A * | 11/1989 | Brandell | E21B 34/14 166/332.4 |
| 5,425,424 | A * | 6/1995 | Reinhardt | E21B 33/16 166/291 |
| 6,112,816 | A * | 9/2000 | Orzechowski | E21B 34/101 166/324 |
| 7,730,965 | B2 * | 6/2010 | Jordan | E21B 21/10 166/358 |
| 10,246,954 | B2 * | 4/2019 | Zhou | E21B 21/003 |
| 2002/0157837 | A1 | 10/2002 | Bode et al. | |
| 2004/0000406 | A1 | 1/2004 | Allamon et al. | |
| 2004/0011534 | A1 | 1/2004 | Simonds et al. | |
| 2004/0221997 | A1 * | 11/2004 | Giroux | E21B 4/02 166/380 |
| 2011/0139453 | A1 | 6/2011 | Schultz et al. | |
| 2011/0203799 | A1 * | 8/2011 | Hofman | E21B 43/00 166/308.1 |
| 2012/0181044 | A1 | 7/2012 | Nikiforuk | |
| 2012/0205120 | A1 * | 8/2012 | Howell | E21B 34/14 166/373 |
| 2013/0213646 | A1 * | 8/2013 | Angman | E21B 47/09 166/255.1 |
| 2014/0196910 | A1 * | 7/2014 | Le | E21B 17/08 166/380 |
| 2014/0238748 | A1 | 8/2014 | DuBose et al. | |

FOREIGN PATENT DOCUMENTS

| | | | |
|---|---|---|---|
| WO | WO 2007/134255 | A2 | 11/2007 |
| WO | WO 2012/096648 | A1 | 7/2012 |

OTHER PUBLICATIONS

United Kingdom Combined Search and Examination Report, issued in Priority Application No. 1508730.7, dated Sep. 7, 2015.
Written Opinion of the International Searching Authority, issued in PCT/NO2016/050073, dated Aug. 12, 2016.

* cited by examiner

METHOD FOR ACHIEVING ZONAL CONTROL IN A WELLBORE WHEN USING CASING OR LINER DRILLING

FIELD OF THE INVENTION

The present invention relates to a method for achieving zonal control in a wellbore when using casing or liner drilling.

BACKGROUND TO THE INVENTION

Operators of oil wells often struggle to get lower completion equipment to a planned depth in a wellbore. This is often due to wellbore failure, such as collapse or similar. Liner Drilling (LD) (e.g. Steerable Drilling Liner (SDL)) systems and casing drilling (both of which line the borehole while it is being drilled) have been designed to overcome this challenge and these now have a proven track record. However, each technology is not currently compatible with sand control equipment and zonal control.

It is therefore an aim of the present invention to provide a method for achieving zonal control in a wellbore when using casing or liner drilling, which helps to address the afore-mentioned problems.

SUMMARY OF THE INVENTION

In accordance with a first aspect of the present invention there is provided a method for achieving zonal control in a wellbore when using casing or liner drilling comprising:

- providing a slotted tubular section in a wellbore while drilling;
- providing a sleeve adjacent to and radially overlapping with the slotted tubular section, while drilling; and
- moving the sleeve relative to the slotted tubular section so as to permit and/or restrict flow through the slotted tubular section in one or more selected zones.

Embodiments of the invention therefore provide a method for controlling the flow through a slotted tubular section in selected zones along a wellbore during production, after the tubular section has been inserted while drilling. The method is particularly advantageous where the tubular section is inserted during a casing or liner drilling procedure because the integrity of the tubular section and sleeve can be maintained during the drilling process (i.e. to prevent flow through the tubular section when drilling) whilst retaining the ability for selective sand and zonal control during production.

It should be noted that the tubular section may be constituted by a casing or liner joint and multiple tubular sections (e.g. casing/liner joints) may be employed to form a continuous tubular casing or liner in the wellbore.

Traditional DL and SDL technology is currently combinable with traditional slotted liner technology (i.e. sand screens) or slotted liners that include dissolvable plugs to ensure liner integrity while drilling. This does, however, not provide any possibility for zonal control as the dissolvable material is dissolved by use of brine, acid or similar, and once the operation is started, all of the plugs are permanently dissolved. The present invention combines liner/casing drilling with a slotted tubular (with or without a coating of dissolvable material) plus a sleeve to provide selective zonal control even when all slots in all parts of the tubular are fully open (i.e. dissolved).

As the tubular section and sleeve are both provided in the wellbore as part of the drilling operation, they can be considered to constitute a drillable sand screen. Embodiments of the invention therefore allow for the drilling of a lower completion to a planned depth (i.e. total depth) while still maintaining the possibility of sand and zonal control.

It should be understood that in the context of the present invention, references to a tubular include references to a casing as well as to a liner such as a steerable drilling liner (SDL). Thus, embodiments of the present invention may be employed when using casing drilling and/or liner drilling (e.g. SDL).

The sleeve may be coaxial with the tubular section and may have a length that is shorter that the tubular section so as to allow room for (axially) moving the sleeve relative to the tubular section.

The sleeve may comprise one or more apertures arranged to selectively align with one or more slots in the slotted tubular section when moved relative thereto. The one or more apertures may be constituted by a plurality of holes substantially of the same size and shape as the slots in the slotted tubular section. In other embodiments, the one or more apertures may be larger or smaller than the slots in the slotted tubular section and/or may comprise different shapes and/or may be arranged in a different pattern. In which case, the one or more apertures may be configured to address specific production related needs and/or requirements.

The slotted tubular section may be initially provided in the wellbore with its slots open or closed. Similarly, the sleeve may be initially provided in the wellbore with its one or more apertures open or closed.

Furthermore, the relative positions of the tubular section and sleeve, when initially provided in the wellbore, may be such that flow through the one or more selected zones may initially be permitted or restricted. In some embodiments, flow through one or more zones may initially be permitted while flow through one or more other zones may initially be restricted. Alternatively, flow through all zones may either be permitted or restricted initially.

The slotted tubular section and/or sleeve may comprise dissolvable material configured to dissolve on contact with a dissolving agent (e.g. brine, acid or similar) so as to create a plurality of holes (i.e. slots/apertures) through the tubular section/sleeve. Thus, the slotted tubular section/sleeve may initially be provided in the wellbore with holes that are closed and that are arranged to be opened on contact with a dissolving agent.

In some embodiments, radial flow through the slotted tubular section may be prevented by the presence of the sleeve adjacent the tubular section.

A seal may be provided between the sleeve and the tubular section to prevent inflow in zones that are meant to be closed. The seal may also be configured to prevent inflow in zones that have been closed after having been open for a time (i.e. due to water production or similar). If part opening of a zone is required, the seal may comprise a wear resistant material to avoid erosion/corrosion caused by a large pressure drop and/or high flow rates adjacent the seal.

An activation tool may be provided to move the sleeve relative to the slotted tubular section. The tool may comprise a gripping mechanism for gripping the sleeve and an actuator configured to generate a force to move the sleeve relative to the tubular section. The gripping mechanism may be friction based. The actuator may comprise a motor or stroker.

The sleeve may be provided outside or inside of the tubular section. However, for ease of operation, it is most likely that the sleeve will be provided inside of the tubular section so that it can be easily moved (e.g. activated) by a downhole activation tool.

The tool may be provided on a drill string, for example, when using liner drilling. Alternatively, the tool may be conveyed on a wireline or coiled tubing, for example, when using casing drilling. Thus, sleeve activation may either be performed with the drill string in place before it is pulled out of the wellbore or on a separate run (after the wellbore has been drilled to a total depth). In some embodiments, both types of tool may be employed, for example, with the drill string tool setting the initial production zones and with the wireline tool being used during production to adjust the production zones.

When the tool is provided on a drill string, the actuator may be constituted by a motor configured to move the entire drill string. The motor may therefore be provided on a surface rig.

The tool may further comprise a setting mechanism to grip the tubular section and provide an anchor for the tool.

A plurality of slotted tubular sections and/or sleeves may be employed. A typical tubular section may be approximately 12 m long. In some embodiments, separate sleeves may be provided for each tubular section. In other embodiments, one sleeve may be configured to open/close more than one tubular section.

The determination of which sleeve to move (i.e. to activate a particular tubular section/zone) may be determined by formation evaluation logging obtained while drilling or may be based on a production profile (i.e. water production) on a later stage of a well lifetime.

Individual sleeves may be moved/activated in a step-wise process.

The step of moving the sleeve relative to the slotted tubular section may comprise one or more of: rotation; pushing; pulling; or stroking upstream or downstream. In particular embodiments it may be advantageous to perform a combination of rotation and pushing/pulling to achieve a choking or adjustable production.

In operation, each tubular section and adjacent sleeve may constitute a separate inflow section which can be configured (by adjustment of the sleeve position) to be fully open, partly open or closed.

In accordance with a second aspect of the present invention there is provided a sleeve for zonal control in a wellbore when using casing or liner drilling. The sleeve may comprise any of the features described above in relation to the first aspect of the invention.

In accordance with a third aspect of the present invention there is provided an activation tool for moving a sleeve relative to a slotted tubular section in accordance with the first aspect of the invention. The tool may comprise any of the features described above in relation to the first aspect of the invention.

According to a fourth aspect of the invention, there is provided an apparatus for carrying out the method according to the first aspect of the invention.

BRIEF DESCRIPTION OF THE DRAWINGS

By way of example, specific embodiments of the present invention will now be described with reference to the accompanying drawings, in which.

DETAILED DESCRIPTION OF CERTAIN EMBODIMENTS

Figure 1:
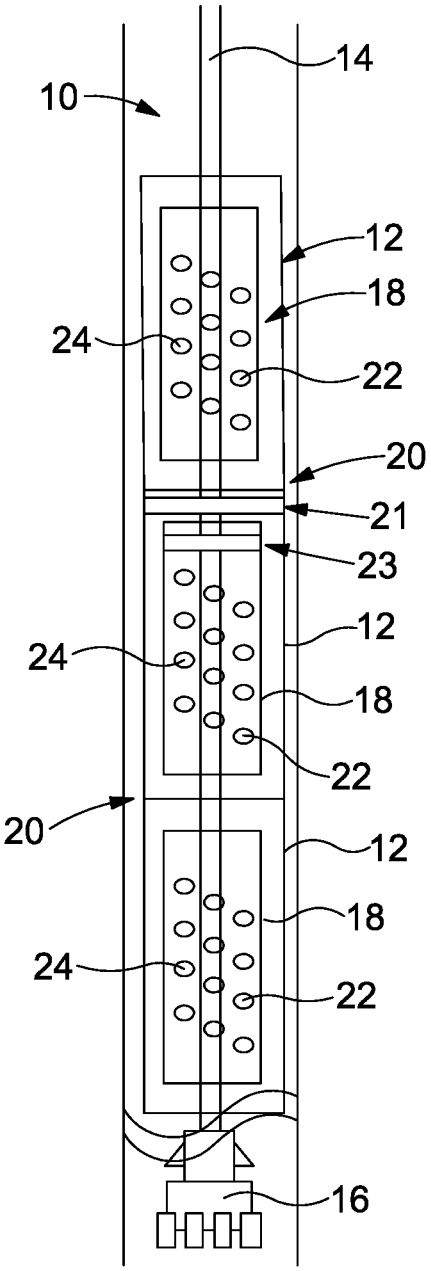
FIG. 1 shows a longitudinal cross-sectional view of a portion of a wellbore provided with apparatus in accordance with a first embodiment of the invention, when deployed in a liner drilling operation.

With reference to FIG. 1, there is illustrated a method and apparatus for achieving zonal control in a wellbore 10 when using liner (or casing) drilling in accordance with a first embodiment of the present invention. The method comprises providing slotted tubular sections 12 in the wellbore 10 while drilling (in this case, using a drill string 14 and bottom hole assembly 16) and providing inner sleeves 18 adjacent to and radially overlapping with each slotted tubular section 12, also while drilling. In practice, both the tubular sections 12 and the sleeves 18 are deployed together on the drill string 14.

As will be explained in more detail below, with reference to FIGS. 3 and 4A to 4C, the method further comprises moving the sleeves 18 relative to the slotted tubular sections 12 so as to permit and/or restrict flow through the slotted tubular sections 12 in one or more selected zones.

Each tubular section 12 is connected to the next tubular section 12 by means of a connection 20. Furthermore, each sleeve 18 is movably connected to a tubular section 12 so that it can be moved relative thereto, for example, by axial movement or rotation of the drill string 14. Thus, in the embodiment of FIG. 1, the drill string 14 (or a portion of it) constitutes an activation tool configured to move each sleeve 18 relative to each slotted tubular section 12, when it is desired to allow radial flow through the slotted tubular sections 12 (e.g. in a production mode). More specifically, the activation tool comprises a setting mechanism 21 configured to hold the tubular sections 12 in place while a local gripping mechanism (i.e. latch/grab device) 23 attaches to the sleeves 18 to move the sleeves 18 relative to the tubular sections 12. The movement may be axial and/or rotational. Although only one activation tool is illustrated in FIG. 1 it will be understood that it may be repeated multiple times along the length of the drill string 14 to selectively manipulate each separate sleeve 18.

The apparatus of FIG. 1 may be used in both an initial deployment operation and for post-deployment positioning of the sleeves 18 relative to the tubular sections 12. The position of the sleeves 18 relative to the tubular sections 12 (i.e. to provide an open, closed or partially open choked arrangement) may initially be set before they are run-in-hole. Subsequently, each sleeve 18 may be selectively re-positioned by use of the local gripping mechanism (i.e. latch/grab device) 23 and depth control of the drill string 14.

Figure 2:
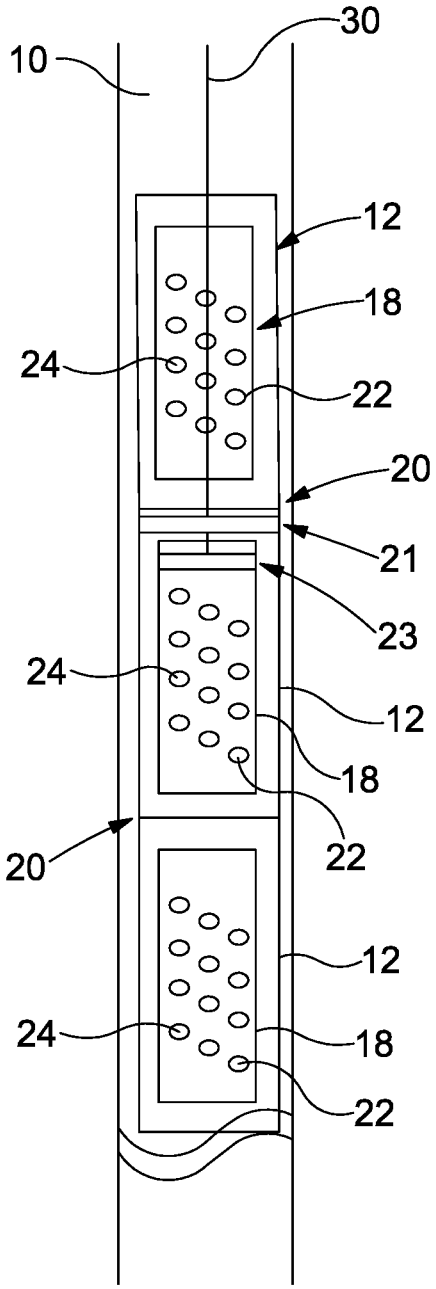
FIG. 2 shows the wellbore of FIG. 1 provided with apparatus in accordance with a second embodiment of the invention, after a drill string has been removed and a wireline tool is deployed.

FIG. 2 shows the wellbore 10 of FIG. 1 after the drill string 14 and bottom hole assembly 16 have been removed and a wireline or coiled tubing tool 30 has been deployed downhole for post-deployment positioning of the sleeves 18 relative to the tubular sections 12. In this embodiment, the sleeves 18 will be selectively positioned by use of a local gripping mechanism (i.e. latch/grab device) 23 and axial movement and/or rotation by the tool 30. In this case, the tool 30 also comprises a setting mechanism 21 configured to anchor the tool (directly or indirectly) to the tubular section 12, while moving a sleeve 18 relative thereto.

Figure 3:
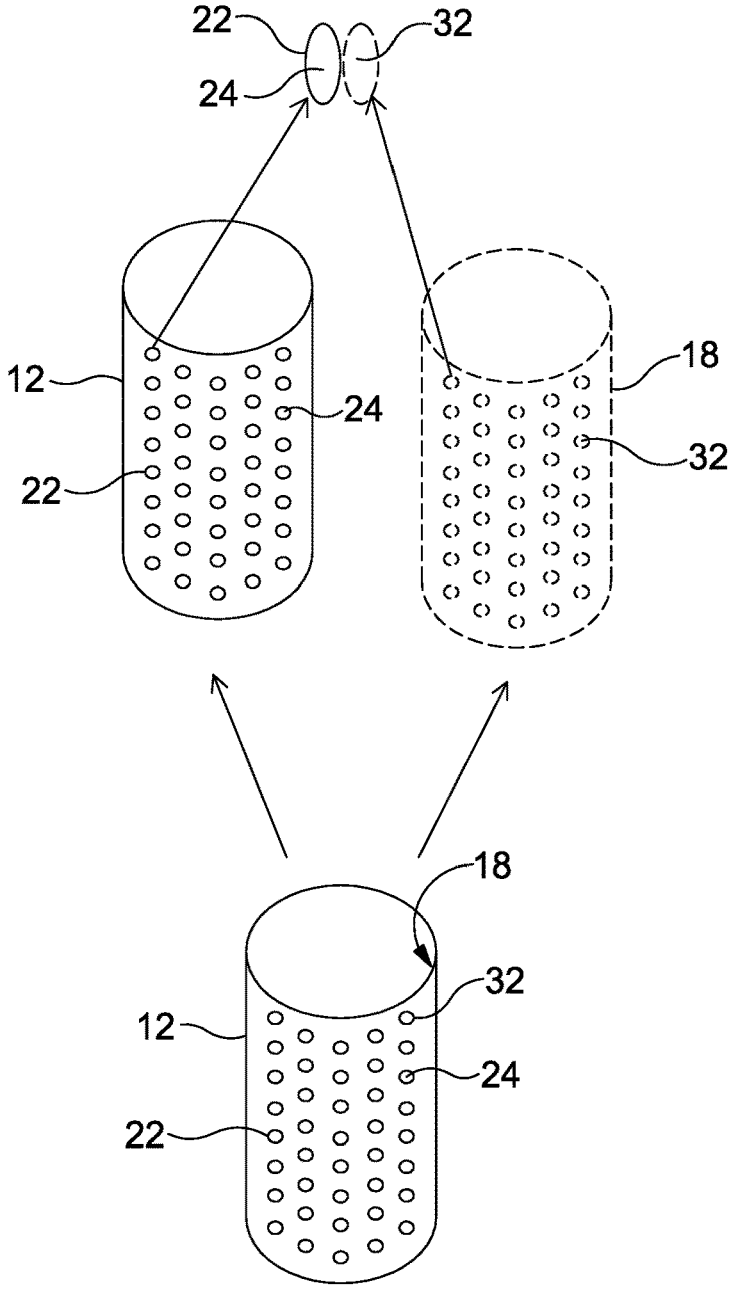
FIG. 3 shows top perspective views of a slotted tubular section and screen from FIGS. 1 and 2, both in a combined state and when separated.

As illustrated in FIGS. 1, 2 and 3, each tubular section 12 is provided with a plurality of slots or holes 22 that are initially closed (i.e. protected or coated) with dissolvable material 24, while the wellbore is being drilled to a required total depth. The dissolvable material 24 is then dissolved by brine, acid or other substances to open all of the holes 22 in the tubular sections 12 prior to or on commencement of production.

More specifically, FIG. 3 shows a tubular section 12 and sleeve 18 in an initial running configuration in which the holes 22 of the tubular section 12 are still closed by the dissolvable material 24 but wherein the sleeve 18 has open holes 32 that are aligned with the tubular section holes 22 (i.e. there is a complete match between the holes in the sleeve 18 and tubular section 12) such that the zone is effectively fully open for production (albeit when the dissolvable material 24 has dissolved).

Figure 4A:
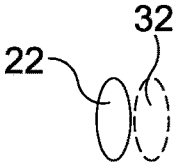
FIG. 4A shows a first configuration of a slot in the slotted tubular section when fully aligned with an aperture in the screen from FIG. 3.

FIG. 4A shows the alignment of the holes 32 in the sleeve 18 when the holes 22 in the tubular section 12 have been opened (by dissolving of the dissolvable material 24) and the relative positions of the sleeve 18 and tubular section 12 are unchanged such that they are still fully aligned and complete radial inflow is permitted.

Figure 4B:
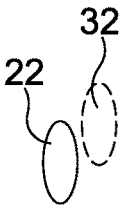
FIG. 4B shows a second configuration of a slot in the slotted tubular section when partly aligned with an aperture in the screen from FIG. 3.

FIG. 4B shows the configuration when the holes 32 in the sleeve 18 are moved partially out of alignment with the holes 22 in the tubular section 12 to form a partially open (i.e. 50%) choke position.

Figure 4C:
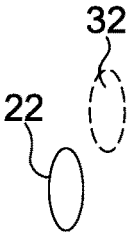
FIG. 4C shows a third configuration of a slot in the slotted tubular section when not aligned with an aperture in the screen from FIG. 3.

FIG. 4C shows the configuration when the holes 32 in the sleeve 18 are moved totally out of alignment with the holes 22 in the tubular section 12 to form a closed position (i.e. to isolate a zone).

It will be noted that the shapes of the holes 32, 22 in both the sleeve 18 and tubular section 12 may be varied (e.g. round, square, rectangle etc) and need not be the same shape in the sleeve 18 and tubular section 12.

It will be appreciated by persons skilled in the art that various modifications may be made to the above-described embodiments without departing from the scope of the present invention, as defined by the claims. In particular, features described in relation to one embodiment may be mixed and matched with features described in relation to one or more other embodiments.

The invention claimed is:

1. A method for achieving zonal control in a wellbore when using casing or liner drilling comprising:

providing a slotted tubular section in a wellbore while drilling;

providing a sleeve adjacent to and radially overlapping with the slotted tubular section, while drilling; and moving the sleeve relative to the slotted tubular section so as to permit and/or restrict flow through the slotted tubular section in one or more selected zones, wherein an activation tool is provided to move the sleeve relative to the slotted tubular section, and the tool comprises a gripping mechanism for gripping the sleeve and an actuator configured to generate a force to move the sleeve relative to the tubular section.

2. The method according to claim 1, wherein the tubular section is constituted by a casing or liner joint and multiple tubular sections are employed to form a continuous tubular casing or liner in the wellbore.

3. The method according to claim 1, wherein the sleeve comprises one or more apertures arranged to selectively align with one or more slots in the slotted tubular section when moved relative thereto.

4. The method according to claim 3, wherein the one or more apertures are constituted by a plurality of holes substantially of a same size and shape as the slots in the slotted tubular section.

5. The method according to claim 3, wherein the one or more apertures are larger or smaller than the slots in the slotted tubular section and/or comprise different shapes and/or are arranged in a different pattern.

6. The method according to claim 1, wherein flow through one or more zones is initially permitted while flow through one or more other zones is initially restricted.

7. The method according to claim 1, wherein flow through all zones is either permitted or restricted initially.

8. The method according to claim 6, wherein the permission and/or restriction of flow through one or more zones is determined by one or more of: relative positions of the tubular section and sleeve; whether slots in the slotted tubular section are open or closed; and whether one or more apertures in the sleeve are open or closed.

9. The method according to claim 1, wherein the slotted tubular section and/or sleeve comprise dissolvable material configured to dissolve on contact with a dissolving agent so as to create a plurality of holes through the tubular section/sleeve.

10. The method according to claim 1, wherein radial flow through the slotted tubular section is prevented by the presence of the sleeve adjacent the tubular section.

11. The method according to claim 1, wherein a seal is provided between the sleeve and the slotted tubular section to prevent inflow in zones that are meant to be closed.

12. The method according to claim 1, wherein the tool is provided on a drill string.

13. The method according to claim 1, wherein the tool is conveyed on a wireline or coiled tubing.

14. The method according to claim 1, wherein the sleeve is provided inside the tubular section.

15. The method according to claim 12, wherein the sleeve is moved relative to the slotted tubular section before the drill string is pulled out of the wellbore.

16. The method according to claim 13, wherein the sleeve is moved relative to the slotted tubular section after the wellbore has been drilled to a total depth.

17. The method according to claim 1, wherein a plurality of slotted tubular sections and/or sleeves are employed.

18. The method according to claim 17, wherein separate sleeves are provided for each tubular section.

19. The method according to claim 17, wherein one sleeve is configured to open/close more than one tubular section.

20. The method according to claim 17, wherein individual sleeves are moved in a step-wise process.

21. The method according to claim 1, wherein the step of moving the sleeve relative to the slotted tubular section comprises one or more of: rotation; pushing; pulling; or stroking upstream or downstream.

22. The method according to claim 1, wherein each tubular section and adjacent sleeve constitutes a separate inflow section which can be configured to be fully open, partly open or closed.

23. The method according to claim 1, wherein the sleeve is coaxial with the tubular section and has a length that is shorter than the tubular section so as to allow room for moving the sleeve relative to the tubular section.

24. A system comprising:

a sleeve for zonal control in a wellbore when using casing or liner drilling, the sleeve being provided adjacent to and radially overlapping with a slotted tubular section in the wellbore, while drilling, wherein the sleeve is movable relative to the slotted tubular section so as to permit and/or restrict flow through the slotted tubular section in one or more selected zones; and an activation tool configured to move the sleeve relative to the slotted tubular section, and comprising a gripping mechanism for gripping the sleeve and an actuator configured to generate a force to move the sleeve relative to the tubular section.

25. An activation tool for moving a sleeve relative to a slotted tubular section in accordance with claim 1, wherein the activation tool is configured to move the sleeve relative to the slotted tubular section, and comprises a gripping mechanism for gripping the sleeve and an actuator configured to generate a force to move the sleeve relative to the tubular section.

* * * * *